United States Patent [19]

Cheng

[11] 4,185,409

[45] Jan. 29, 1980

[54] TEETER-TOTTER TRACK SECTION FOR MODEL VEHICLES

[76] Inventor: Richard C. M. Cheng, Suite 1604, Austin Center, Kowloon B.C.C., Hong Kong

[21] Appl. No.: 896,773

[22] Filed: Apr. 17, 1978

[51] Int. Cl.[2] ..... A63H 18/12; A63H 18/16

[52] U.S. Cl. ..... 46/1 K; 46/257; 104/79; 238/10 F

[58] Field of Search ..... 46/1 K, 45, 251, 252, 46/257, 258, 259; 238/10 R, 10 F; 104/79

[56] References Cited

U.S. PATENT DOCUMENTS

| | | | |
|---|---|---|---|
| 740,765 | 10/1903 | Needham | 104/79 X |
| 1,523,244 | 1/1925 | Bain | 104/79 |
| 1,715,891 | 6/1929 | Beck | 104/79 |
| 1,965,676 | 7/1934 | Stock | 104/79 |
| 2,815,872 | 12/1957 | Graham | 104/79 |
| 4,068,402 | 1/1978 | Tanaka | 46/257 |
| 4,094,089 | 6/1978 | Sano | 46/1 K |

*Primary Examiner*—F. Barry Shay
*Attorney, Agent, or Firm*—Robert K. Youtie

[57] ABSTRACT

A teeter-totter or see-saw track section including a base part interposable in a track system and a super track part mounted on the base part for oscillation about a generally horizontal transverse axis, together with electrical connection means between the base and super track parts to enable an operator to effect powered control of a model vehicle on the super track part.

9 Claims, 3 Drawing Figures

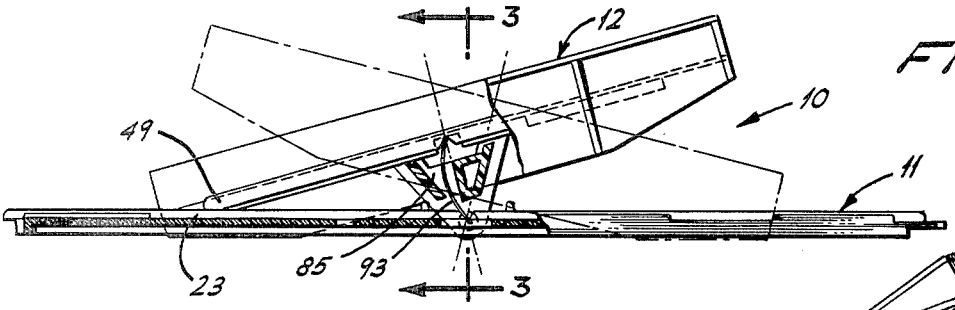
FIG. 1.
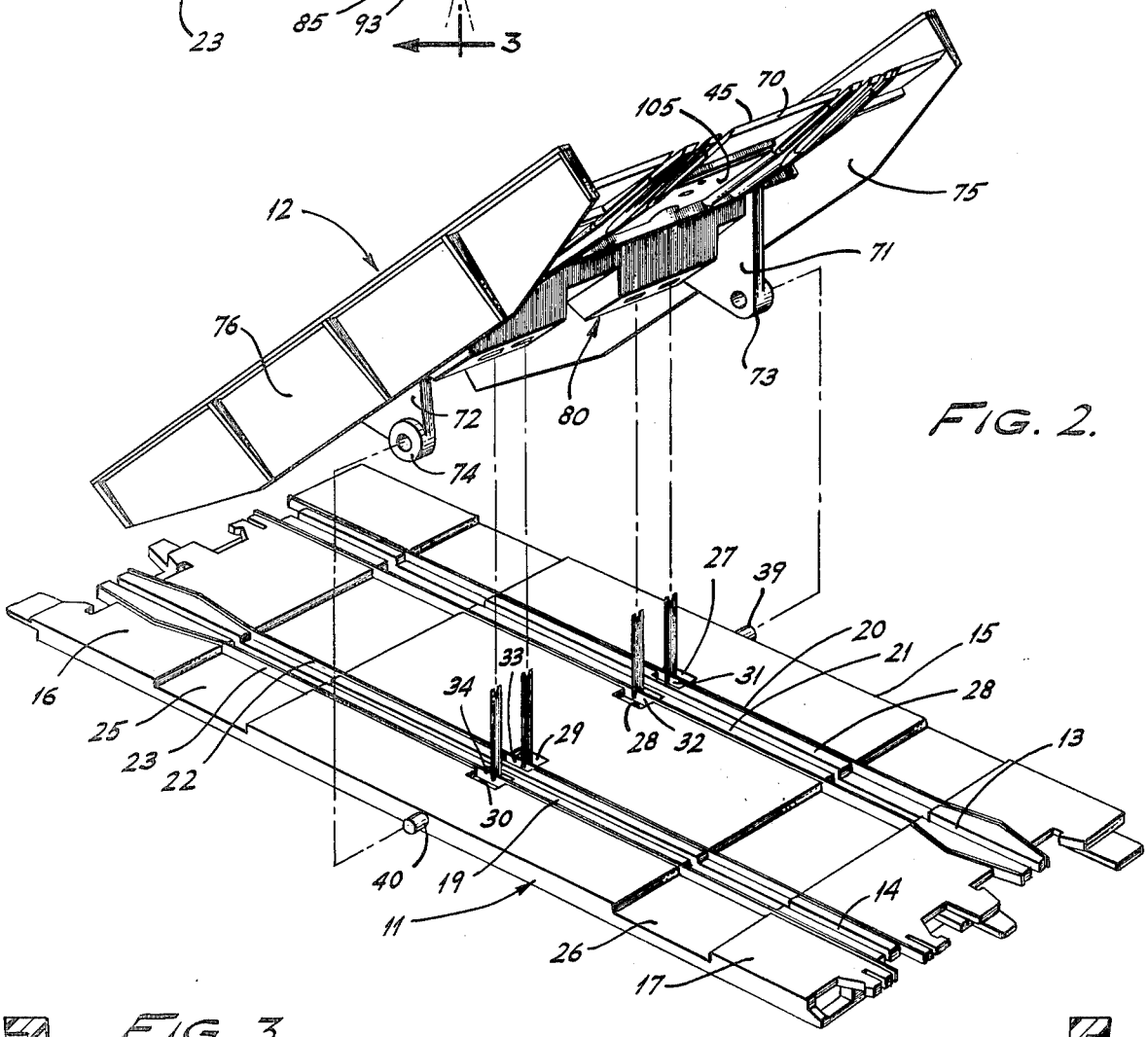
FIG. 2.
FIG. 3.
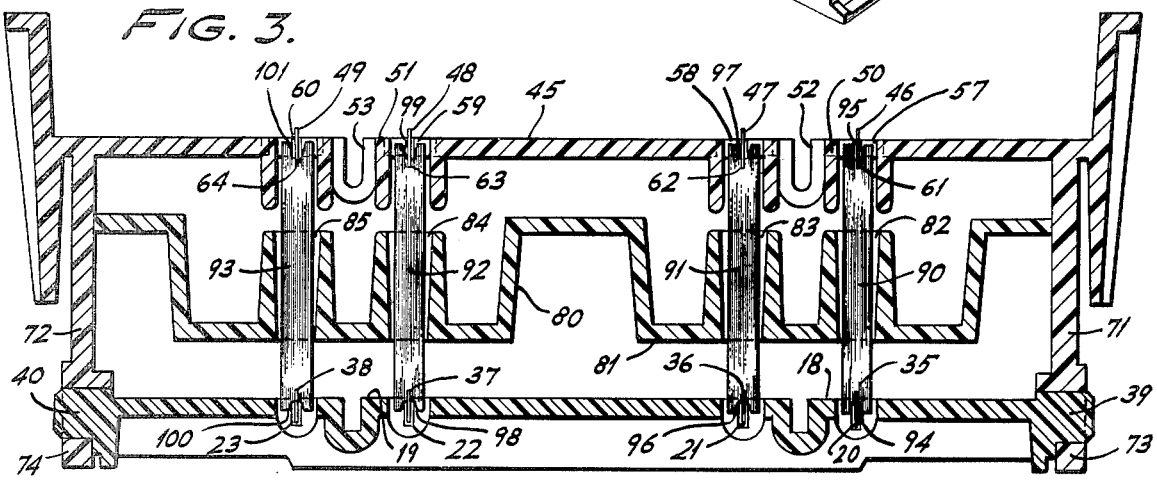

TEETER-TOTTER TRACK SECTION FOR MODEL VEHICLES

BACKGROUND OF THE INVENTION

While there have been proposed prior art devices in the nature of see-saws or teeter-totters for use in model and full size road systems, such devices have required self-contained powered vehicles, powered teeter-totter structures, or gravitationally operable devices, all without the possibility of external or remote control of a vehicle to effect the desired movement thereof along the track system and included see-saw section.

SUMMARY OF THE INVENTION

Accordingly, it is an important object of the present invention to provide a teeter-totter or track section for use in a model vehicle track system wherein the vehicle may be externally or remotely controlled by an operator, both in speed and direction for movement along the track system, including movement along the see-saw section under the remote operator control.

It is a further object of the present invention to provide a see-saw track section of the type described which is extremely simple in construction for manufacture, assembly and sale at a reasonable cost, highly durable and reliable in operation for achieving a long, trouble-free life, and which is neat and attractive in appearance and quickly and easily incorporated in a model vehicle track system for use therein to provide attention arresting entertainment to persons of widely varying ages, interests and skills.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a side elevational view showing a see-saw track section of the present invention being partly broken away to illustrate internal construction, and illustrating in phantom an oppositely swung position of the see-saw track section.

FIG. 2 is an exploded perspective view showing parts of the see-saw track section in a disassembled relation.

FIG. 3 is a transverse sectional elevational view taken generally along the line 3—3 of FIG. 1.

DESCRIPTION OF THE PREFERRED EMBODIMENT

Referring now more particularly to the drawings, and specifically to FIG. 1 thereof, a see-saw track section is there generally designated 10, and may include a generally flat, normally substantially horizontal base part 11, above which is mounted a longitudinally extending super track part 12.

The base track part 11 may include a generally flat, planar body 15, of generally longitudinal extent and having opposite end portions 16 and 17 configured for respective mating engagement with like ended sections of a model vehicle track system. Thus, the base part 11 of see-saw track section 10 is adapted to be interposed in any desired model vehicle track system by provision of appropriate end portions 16 and 17. The base part 11 may include a pair of longitudinally extending, side by side lanes or tracks, as at 18 and 19, as illustrated, or other desired number of lanes. Each lane, as at 18 and 19 includes a pair of conductors or rails, such as the conductors or rails 20 and 21 of lane 18 and the conductors or rails 22 and 23 of lane 19. The conductors 20–23 of base part 11 are disposed longitudinally of and suitably embedded within the body 15, extending into the end portions 16 and 17 for engagement and electrical connection with like conductors of adjacent and mating track sections (not shown). The conductors 20–23 may each be an elongate metallic or otherwise conductive strip extending longitudinally of the body 15 with one edge uppermost for wiping engagement with a vehicle shoe or wiper, in the conventional manner.

Adjacent to and spaced inwardly from respective end portions 16 and 17 of base part body 15, the upper surface of the body may be configured, as by laterally extending recesses 25 and 26, respectively. More specifically, the recesses 25 and 26 may be generally rectangular in outline configuration, extending entirely laterally across and opening laterally outwardly through opposite sides of the body 15. As is apparent from FIG. 2, the conductors 20–23, in their portions extending through recesses 25 and 26, are more exposed, or have a greater width projecting upwardly beyond the adjacent body surface, than the conductor portions passing through the non-recessed regions of body 15.

However, there are provided longitudinally medially of the body 15 a plurality of vertically opening through apertures or holes, as at 27, 28, 29 and 30. The through apertures or holes 27–30 are located to respectively receive and pass therethrough the conductors 20–23. In particular, the intermediate portions 31, 32, 33 and 34 of respective metallic strips or conductors 20, 21, 22 and 23 pass medially across respective through openings 27, 28, 29 and 30. Further, the respective conductor portions 31–34 are configured, as by upwardly facing notches 35, 36, 37 and 38, see FIG. 3, for a purpose appearing presently.

The through openings 27–30 are formed in the body 15 along a laterally or transversely extending zone of the body, generally normal to the longitudinal direction of the body. Further, in alignment with the several openings 27–30 and conductor notch formations 35–38, there may be provided outstanding from opposite sides of the body 15 a pair of stub shafts, pins or pintles 39 and 40.

The super structure or part 12 may include a generally flat body or bed 45 normally disposed longitudinally of and superposed over the base part body or bed 15. The super part body or bed 45 may be generally flat, and provided therein with a plurality of longitudinally extending, metallic strips or conductors 46, 47, 48 and 49 embedded in or otherwise suitably carried longitudinally by the super part body or bed 45. One pair of conductors 46, 47 may define a lane or track 50, disposed over the lower lane 18 of lower part 11, while the other pair of longitudinal conductors 48 and 49 may define a lane or track 51 being disposed over the lower part lane or track 19. The upper or super part lanes 50 and 51 may be provided along a laterally medial location, longitudinally thereof, with a guidance slot, as at 52 and 53, respectively. Similarly, the lower track part 11 may be provided in each lane 18 and 19, laterally medially thereof, with longitudinally extending slots 13 and 14. The slots 13, 14, 52 and 53 may provide guidance for vehicles, in the usual manner.

Provided in a laterally extending zone of the upper part bed or body 45, there may be a plurality of through openings or holes, as at 57, 58, 59 and 60. In particular, the row of holes 57–60 may be located longitudinally midway of the bed 45, substantially directly over respective through holes or openings 27–30 of the lower body 15. The conductors 46–49 may also be of metal strips, having an upper edge exposed beyond the upper surface of upper part body 45 for engagement by the wipers or shoes of a vehicle, and may be exposed downwardly through body openings 57–60, for access to the lower edges of the conductors or rail strips. Further, the exposed lower edge regions of strips 46–49 may be provided with downwardly facing formations, in the nature of notches, as at 61, 62, 63 and 64.

The upper part bed or body 45 has its opposite end portions, on its underside, bevelled or chamfered, as at 70 in FIG. 2, and the conductors or strips 46–49 may terminate slightly short of the ends of upper part body 45, for resting engagement on respective lower conductors 35–38, as may be seen in FIG. 1.

Depending from the super track part body 45, on opposite sides thereof, in general alignment with the laterally arranged row of openings 57–60, may be a pair of arms or ears 71 and 72 provided at the lower ends with sleeves or bearings 73 and 74 to define gudgeons for rotatably receiving respective pintles 39 and 40. The gudgeons 73 and 74 are resiliently displaceable outwardly away from each other for reception of respective pins or stubs 39 and 40, and releasable for retention thereof, so as to mount the super track part 12 longitudinally of and over the base track part 11.

A pair of protective side pieces 75 and 76 extend longitudinally along and outward of respective side edges of the super track part body 45, to provide side walls on the super track part and may simulate bridge girders, as illustrated.

In addition to the foregoing, there is provided on the underside of super track body 45, beneath the laterally aligned row of openings 57–60, a hollow guide part 80. The hollow guide part 80 may include a lower wall 81 provided with a plurality of through openings 82, 83, 84 and 85 in respective alignment with the top part body openings 57, 58, 59 and 60. The hollow guide part 80 may be adhesively or otherwise secured in position beneath the underside of super track part body 45 in the hereinbefore described aligned relationship.

A plurality of electrical connectors are respectively designated 90, 91, 92 and 93 and may each be constituted of an elongate resilient conductive strip or leaf extending through respective guide openings 82–85 between interfitting engagement with conductors of the base and super track part 11 and 12.

Specifically, the electrical connectors or resilient strips 90–93 are each provided at its opposite ends with notched formations for interfitting engagement with the associated lower and upper part conductors. Thus, electrical connector, strip or leaf 90 has its lower and upper ends formed with downwardly and upwardly facing notches 94 and 95, respectively, for interfitting engagement with respective notches 35 and 61 of lower and upper conductors 20 and 46. Similarly, resilient connector leaf or strip 91 has lower and upper notches 96 and 97 in respective interfitting engagement with the notches 36 and 62 of lower and upper conductors 21 and 47. Similarly, electrical connector strip or leaf 92 is provided at its lower and upper ends with downwardly and upwardly facing notches 98 and 99 for respective interfitting engagement with grooves 37 and 63 of lower and upper conductors 22 and 48, while connector strip or leaf 93 is provided at its lower and upper ends with notches 100 and 101 for respective interfitting engagement with the notches 38 and 64 of lower conductor 23 and upper conductor 49.

Further, as best seen in FIG. 1, the several openings 82–85 (the latter being shown therein) are open in one direction longitudinally of the track section 10, leftward in the illustrated embodiment. By reason of this longitudinal opening of guide ways 82–85, the several resilient electrical connectors or leaf strips 90–93 are deflectable for resilient displacement longitudinally leftward, as seen in FIG. 1. By this resilient deflection, the several connector leaves 90–93 are self-maintaining in electrical connection between respective lower and upper part conductors. Also, as the forces imparted by the several resiliently deflected strips 90–93 extend substantially through the axis of pintles 39, 40, there is no appreciable turning force applied to the super see-saw track part 12 relative to the base part 11.

In assembly, it has been found advantageous to invert the super track part 12 and place the several connector strips 90–93 in the their respective openings 82–85 so as to stand substantially upright therefrom in their undistended condition, it being appreciated that the connector strips are in their interfitting engagement with the conductors of the super track part. It is then only necessary to lower the inverted base part 11 to simultaneously engage the free ends of the several connector strips 90–93 in interfitting relation with the notched regions of base part conductors 20–23 and snap engage the journals or gudgeons 73, 74 about the pintles 39 and 40.

In use, by the recesses 25 and 26 of the base part body 15 and the chamfered ends 70 of the super part body 45, the ends of the super part body are swingable downwardly into resting engagement with the base part body to form a smoothly merging ramp with the latter. Thus, a remotely electrically powered vehicle may ride from one of the lanes 18, 19 upwardly onto the super body part 12 on a respective lane 50, 51 while receiving electrical power from the conductor strips 46–49 of the super track part. Thereby the vehicle may be energized to slowly proceed across the rotative axis of the super body part and swing the latter about its rotative axis to raise the heretofore downward end and block access by a following vehicle. Otherwise, if desired, an operator may briskly control his vehicle to ride up and over the ramp of super body part 12, being projected therefrom onto the track system for a fairly good probability of landing in a guided lane for continued operation.

In order to control the speed of movement of super track part 12 about its mounting axis of pins 39 and 40, there may be provided suitable weights, as at 105, on opposite sides of the pintle axis.

From the foregoing, it is seen that the present invention provides a see-saw track section for model vehicles which is extremely simple in construction, admirably well-suited to achieve its intended objects, and capable of imparting considerably additional fun and excitement in model vehicle operation.

Although the present invention has been described in some detail by way of illustration and example for purposes of clarity of understanding, it is understood that certain changes and modifications may be made within the spirit of the invention.

What is claimed is:

1. A see-saw track section interposable in a model vehicle track system having electrical conductors, said see-saw track section comprising a base track part having electrical conductors and mechanically and electrically interposable in the track system, a super track part having electrical conductors and located longitudinally over said base track part, means mounting said super track part for swinging movement about a transverse axis to alternatively place either end of super track part downwardly on said base track part and the opposite end upwardly spaced over said base track part, and electrical connection means between the conductors of said base and said super track part, for controlling movement of an electrically powered vehicle from said base track part onto the downward end of said super track part and upwardly therealong past said axis for gravitational swinging of said opposite end downwardly.

2. A see-saw track section according to claim 1, the upper surface of said base track part and the under surface of said super track part being configured for mating engagement to define at said base track part and the downward end of said super track part a smoothly merging ramp.

3. A see-saw track section according to claim 2, said electrical connection means including structure on said base and super track parts whereby said super track part conductors rest on said base track part conductors at the downward end of said super track part.

4. A see-saw track section according to claim 1, said electrical connection means comprising resilient conductive means interposed in resiliently deflected condition between said super and base track part conductors.

5. A see-saw track section according to claim 4, said resilient conductive means each comprising a resilient leaf having its opposite ends in interengagement with said super and base track part conductors.

6. A see-saw track section according to claim 5, said resilient leaves each havings its opposite ends notched for said interfitting engagement.

7. A see-saw track section according to claim 5, said super and base track part conductors being notched for said interengagement.

8. A see-saw track section according to claim 1, said mounting means comprising gudgeons outstanding from one of said super and base track parts, and pintles outstanding from the other of said track parts into said gudgeons.

9. A see-saw track section according to claim 8, said electrical connection means comprising resilient leaves each having its opposite ends in interfitting engagement with said super and base track part conductors, and a support structure carried by said one of said super and base track parts for supporting said leaves generally upright to facilitate assembly of said gudgeons and pintles.

* * * * *